US010202258B2

(12) United States Patent
Dold et al.

(10) Patent No.: US 10,202,258 B2
(45) Date of Patent: Feb. 12, 2019

(54) METHOD FOR DETERMINING STATE OF ELEVATOR SYSTEM COMPONENT

(71) Applicant: Inventio AG, Hergiswil (CH)

(72) Inventors: Florian Dold, Root (CH); Urs Lindegger, Ebikon (CH)

(73) Assignee: INVENTIO AG, Hergiswil (CH)

( * ) Notice: Subject to any disclaimer, the term of this patent is extended or adjusted under 35 U.S.C. 154(b) by 130 days.

(21) Appl. No.: 15/514,005

(22) PCT Filed: Sep. 17, 2015

(86) PCT No.: PCT/EP2015/071308
§ 371 (c)(1),
(2) Date: Mar. 24, 2017

(87) PCT Pub. No.: WO2016/046052
PCT Pub. Date: Mar. 31, 2016

(65) Prior Publication Data

US 2017/0275135 A1 Sep. 28, 2017

(30) Foreign Application Priority Data

Sep. 26, 2014 (EP) ..... 14186633

(51) Int. Cl.
*B66B 5/14* (2006.01)
*B66B 5/02* (2006.01)
(Continued)

(52) U.S. Cl.
CPC ..... *B66B 5/14* (2013.01); *B66B 1/3476* (2013.01); *B66B 5/0037* (2013.01); *B66B 5/02* (2013.01);
(Continued)

(58) Field of Classification Search
CPC ..... B66B 5/14; B66B 1/3476
(Continued)

(56) References Cited

U.S. PATENT DOCUMENTS 3,627,082 A * 12/1971 Berkovitz ..... B66B 13/26 187/317
3,743,058 A * 7/1973 Diamond ..... B66B 13/26 187/317
(Continued)

FOREIGN PATENT DOCUMENTS

CN 1898309 A 1/2007
CN 102616628 A 8/2012
(Continued)

*Primary Examiner* — David Warren
(74) *Attorney, Agent, or Firm* — William J. Clemens; Shumaker, Loop & Kendrick, LLP

(57) ABSTRACT

A method determines a status of at least one component of an elevator system, wherein the elevator system includes a suspension apparatus having at least one traction member. The at least one traction member is surrounded by a non-metallic cladding, wherein the suspension apparatus is guided via a drive sheave with a metallic traction surface. The method includes the steps of: identifying at least one parameter based on an electrostatic effect which occurs due to friction of the non-metallic cladding on the traction sheave with the metallic traction surface; and determining a status of the at least one component on the basis of the identified parameter.

15 Claims, 2 Drawing Sheets

(51) Int. Cl.
*B66B 7/12* (2006.01)
*B66B 1/34* (2006.01)
*B66B 5/00* (2006.01)
*B66B 7/06* (2006.01)

(52) U.S. Cl.
CPC ..... *B66B 7/1215* (2013.01); *B66B 7/1223* (2013.01); *B66B 7/062* (2013.01)

(58) Field of Classification Search
USPC ..... 187/393
See application file for complete search history.

(56) References Cited

U.S. PATENT DOCUMENTS 4,191,894 A * 3/1980 Noda ..... B66B 13/26 307/116
4,208,695 A * 6/1980 Noda ..... B66B 13/26 307/116
4,983,896 A * 1/1991 Sugiyama ..... B60J 7/05 187/317
5,001,459 A * 3/1991 Jacoby ..... B66B 29/04 198/323
5,149,921 A * 9/1992 Picado ..... B66B 13/26 187/317
5,245,315 A * 9/1993 Johnson ..... B66B 29/04 198/323
5,864,101 A * 1/1999 Nishizawa ..... B60P 1/4471 187/222
7,123,030 B2 10/2006 Robar et al.
7,360,643 B1 * 4/2008 Fandella ..... B65G 17/08 198/321
9,162,818 B2 * 10/2015 van den Berg ..... B65G 17/08
9,975,734 B2 5/2018 Dold et al.
10,023,433 B2 7/2018 Dold et al.
2011/0148442 A1 * 6/2011 Berner ..... B66B 7/1223 324/691
2011/0192683 A1 * 8/2011 Weinberger ..... B66B 7/1215 187/254
2013/0153340 A1 6/2013 Dold
2014/0318932 A1 * 10/2014 van den Berg ..... B65G 17/08 198/853
2015/0222207 A1 * 8/2015 Matsushita ..... B66F 9/02 318/376
2017/0275135 A1 * 9/2017 Dold ..... B66B 5/02

FOREIGN PATENT DOCUMENTS

CN 104755405 A 7/2015
CN 104854012 A 8/2015
JP WO 2017009920 A1 * 1/2017 ..... B66B 1/46
WO 2010098756 A1 9/2010

* cited by examiner

METHOD FOR DETERMINING STATE OF ELEVATOR SYSTEM COMPONENT

FIELD

The present invention concerns a method for determining a state of at least one component of an elevator system.

BACKGROUND

In order to ensure reliable operation of an elevator system, various components are monitored in elevator systems. Thus, for example, the speed of travel of an elevator car is monitored, wherein operation of the elevator system is adjusted if an impermissible speed of travel of the elevator car is established. Furthermore, a loading state of the elevator car is monitored in elevator systems. For example, a state of a suspension means is an important indicator for reliable operation of the elevator system. For example, tensile stresses can be determined in various suspension means of an elevator system, as can the state of the suspension means itself. In particular in the case of belt-type suspension means with jacketed tension load-carrying members, it is essential for reliable operation of the elevator system that both the state of the tension load-carrying members and also the state of the jacketing can be regularly monitored.

For each of the aforementioned states of a component of the elevator system different monitoring options and monitoring devices exist in some cases. Thus U.S. Pat. No. 7,123,030B2 discloses, for example, a method for determining the degree of wear of a belt-type suspension means. On the basis of a specific electrical resistance of the electrically conducting tension load-carrying members a breaking force is defined for the suspension means. However, what is disadvantageous in such monitoring methods that are already of known art is the fact that for comprehensive monitoring of the elevator system a variety of monitoring methods are necessary, and therefore a variety of monitoring equipment. Thus, for example, one monitoring system is required for the state of the suspension means, and another monitoring system is required for the running state of the elevator car. Furthermore, for example, a further monitoring system is required to check the state of stress of the suspension means. This has the consequence that increased installation costs thereby arise, together with increased material costs for elevator systems.

SUMMARY

It is therefore an object of the present invention to make available a method for determining a state of at least one component of an elevator system, which permits a statement to be made concerning the state of various components of the elevator system. It should also be possible to execute the method with cost-effective means.

For purposes of achieving the said object a method is firstly proposed for determining a state of at least one component of an elevator system. Here the elevator system comprises a suspension means with at least one tension load-carrying member. The tension load-carrying member is surrounded by an electrically insulating jacket, wherein the suspension means is guided by way of a drive pulley with a metallic traction surface. The method comprises the steps: Determination of at least one parameter based on an electrostatic effect, which arises as a result of the friction of the non-metallic jacket on the drive pulley with the metallic traction surface during a car journey, and determination of the state of the component on the basis of the parameter recorded.

This method has the advantage that on the basis of a naturally occurring effect, namely the electrostatic effect between the drive pulley and the suspension means, the states of various components of the elevator system can be determined. Thus it is not necessary for a specific signal firstly to be generated, since the said electrostatic effect occurs naturally.

Previously, such electrostatic effects have not been taken into consideration, or attempts have been made to reduce such electrical voltages, in order to minimize any potential risk originating from them. By virtue of a long series of tests, the inventors are now able to demonstrate a variety of linear or higher order dependencies of various electrostatic effects on the state parameters of components of the elevator system. Thus there exists, for example, a direct relationship between the voltage generated by the electrostatic effect and the speed of travel of the elevator car. Depending upon the monitoring purpose, a parameter of the electrostatic effect can be selected, together with an evaluation method for the parameter determined.

In an advantageous example of embodiment the suspension means comprises at least one electrically conducting element. This has the advantage that by this means determination of the parameter based on the electrostatic effect can be designed more easily. Such an electrically conducting element within the suspension means can, for example, serve as an electrical conductor, which transmits the electrostatic effect arising between the drive pulley and the jacket of the suspension means. A level of voltage or current can be determined in a simple manner on this electrical conductor.

In an advantageous development the tension load-carrying member comprises plastic fibers, wherein an indicator element is arranged in the suspension means. In an alternative development the tension load-carrying member comprises an electrically conducting material. In both of the alternative developments cited an electrically conducting element is provided within the suspension means. In the case of tension load-carrying members that comprise an electrically conducting material, the advantage consists in the fact that no separate indicator element must be provided. In the case of tension load-carrying members with plastic fibers and a separately arranged indicator element, the advantage consists in the fact that the tension load-carrying members made of plastic fibers have a significantly lower weight than metallic tension load-carrying members.

In an advantageous example of embodiment an electrical voltage and/or electrical current is determined in the electrically conducting element as a parameter. This has the advantage that such a parameter can be determined cost effectively using simple means.

In an advantageous development, by means of repeated determination of the electrical voltage and/or electrical current in the electrically conducting tension load-carrying member any alteration of the load capacity of the tension load-carrying member, and therefore of the suspension means, is detected. For example, it is possible to infer, from an alteration of the electrical voltage and/or electrical current under the same running conditions of the elevator system, that a change has occurred in the conducting cross-section of the tension load-carrying member, which in turn is an indicator for the load capacity of the tension load-carrying member. If, for example, a first current level is determined during a car journey under constant loading from a first to a second floor, and a short time later a current level deviating from the first is determined while the journey distance and the loading remain the same, this can be an indication of an altered electrical resistance of the tension load-carrying member, which in turn can be an indication of an altered load capacity of the tension load-carrying member.

In an advantageous example of embodiment a loading state of the suspension means is determined. This has the advantage that various important functions of the elevator system can be checked by this means.

In an exemplary development any relaxation of stress in a suspension means can be detected by determining the loading state of the suspension means. In an alternative exemplary development the elevator system comprises two or more suspension means, wherein by determining the loading state of the suspension means a distribution of the load onto the two or more suspension means can be detected.

In an advantageous example of embodiment the running state of an elevator car is determined. By this means important functions of the elevator system can in turn be monitored. In an exemplary development the speed of travel of the elevator car can thereby be determined. In an alternative development the duration and/or number of journeys of the elevator car can be determined.

In an advantageous example of embodiment a state of the jacket is determined. Here too the advantage ensues that by determining the state of the jacket various important functions of the elevator system can be checked. In an exemplary development any contamination of the jacket surface, and/or wear of the jacket surface, and/or ageing of the jacket surface, can be determined.

In an advantageous example of embodiment a state of the electrically conducting tension load-carrying member is determined. This has the advantage that the tension load-carrying members of the suspension means, usually invisible within the jacketing, can be monitored. In an advantageous development any contact of the electrically conducting tension load-carrying member with an earthed element, and/or fracture of a tension load-carrying member, can be determined.

The method here disclosed for monitoring a state of at least one component of an elevator system can be employed in various types of elevator systems. Thus, for example, elevator systems can be employed with or without a shaft, with or without a counterweight, as can elevator systems with different transmission ratios. In this manner each suspension means in an elevator system, which comprises a non-metallic jacket, which interacts with a metallic traction surface of a drive pulley, can be monitored using the method here disclosed.

DESCRIPTION OF THE DRAWINGS

With the aid of figures the invention is described symbolically and in an exemplary manner in more detail. Here.

DETAILED DESCRIPTION

Figure 1:
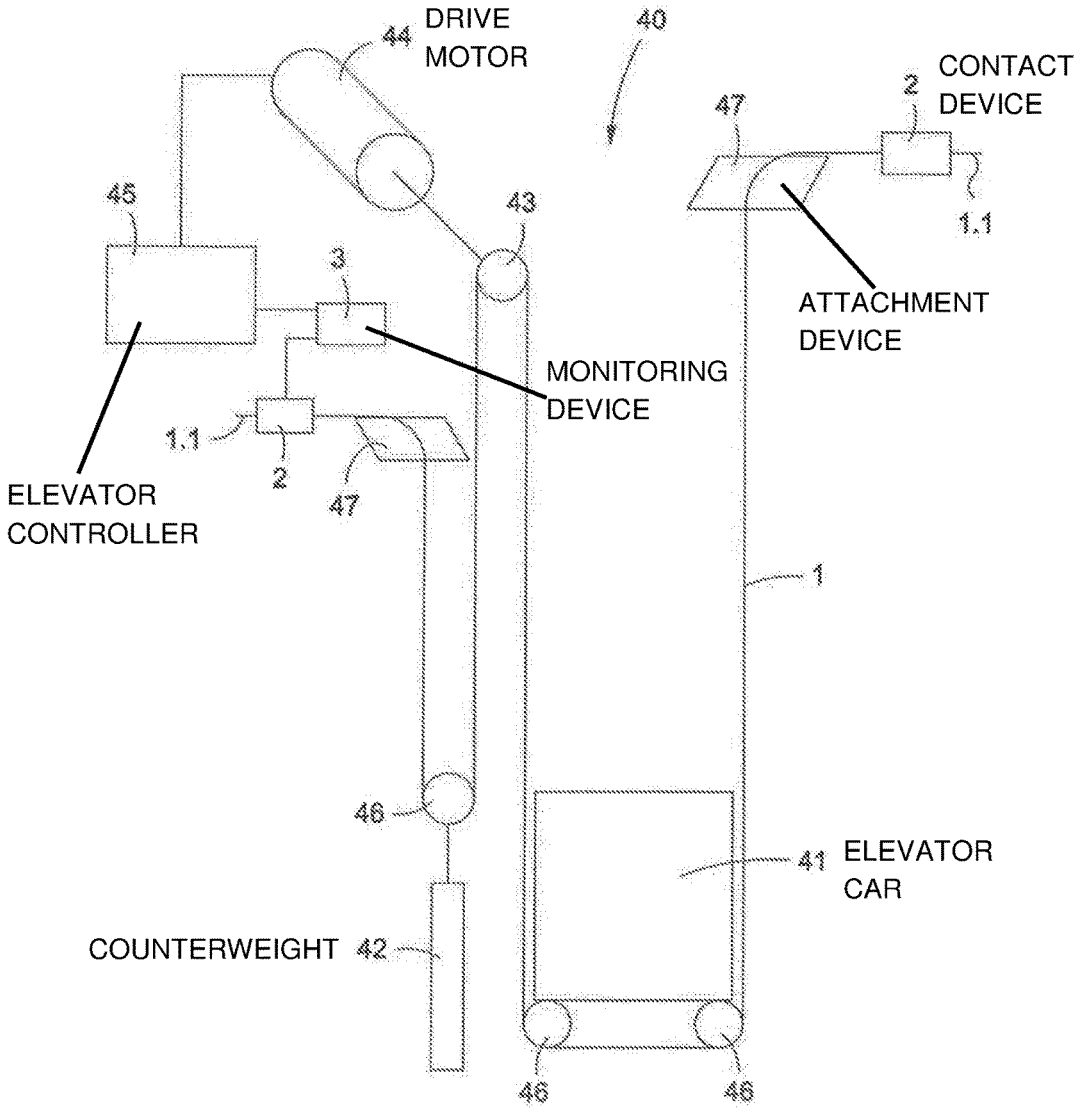
FIG. 1 shows an exemplary form of embodiment of an elevator system.

The elevator system 40 represented schematically and in an exemplary manner in FIG. 1 features an elevator car 41, a counterweight 42 and a means of suspension 1, together with a drive pulley 43 with an associated drive motor 44. The drive pulley 43 drives the suspension means or suspension apparatus 1 and thus moves the elevator car 41 and the counterweight 42 in opposition. The drive motor 44 is controlled by an elevator controller 45. The car 41 is configured to accommodate people or goods, and to transport these between floors of a building. Car 41 and counterweight 42 are guided along guides (not represented). In the example the car 41 and the counterweight 42 are each suspended on load-bearing rollers 46. Here the suspension means 1 is secured to a first suspension means attachment device 47, and is then firstly guided around the load-bearing roller 46 of the counterweight 42. The suspension means 1 is then laid over the drive pulley 43, around the load-bearing roller 46 of the car 41, and is finally connected by means of a second suspension means attachment device 47 to a fixed point. This means that the suspension means 1 runs with a higher speed in accordance with a transfer factor over the drive 43, 44, than the car 41 or counterweight 42 move. In the example the transfer factor is 2:1.

A free end 1.1 of the suspension means or suspension apparatus 1 is provided with a contact device 2 for purposes of making temporary or permanent electrical contact with the tension load-carrying members 1. In the example represented such a contact device 2 is arranged at both ends 1.1 of the suspension means 1. In an alternative form of embodiment, not represented, only one contact device 2 is arranged at one of the ends 1.1 of the suspension means, and the tension load-carrying members are connected with one another at the other end 1.1 of the suspension means. The suspension means ends 1.1 are no longer loaded by the tensile force in the suspension means 1, since the said tensile force is already previously directed via the suspension means attachment devices 47 into the building. The contact devices 2 are therefore arranged in a region of the suspension means 1 that is not rolled over, and outside the loaded region of the suspension means 1.

In the example the contact device 2 is connected at one end 1.1 of the suspension means or apparatus with a monitoring device 3. The monitoring device 3 thereby interconnects the tension load-carrying members of the suspension means 1 as electrical conductors in electrical circuitry for purposes of determining an electrical parameter, which can be, for example, an electrical voltage and/or an electrical current. The monitoring device 3 is also connected with the elevator controller 45. This connection can, for example, be designed as a parallel relay or as a bus system. By this means a signal or a measured value from the monitoring device 3, can be transmitted to the elevator controller 45, in order to take account of the state of at least one component of the elevator system 40, as determined by the monitoring device 3, in controlling the elevator 40.

During a journey of the elevator car 41 the non-metallic jacket of the suspension means or suspension apparatus 1 interacts with the metallic traction surface of the drive pulley 43. Here, a movement of the drive pulley 43 is transferred by means of traction onto the suspension means. During this transfer an electrostatic effect arises, wherein the metallic drive pulley delivers electrons onto the non-metallic belt jacket. As a result different charges can be established in the elements affected of the elevator system 40. Here the electrical voltage, which builds up on the jacket of the suspension means 1, can discharge by way of an electrically conducting element, which is also located in the suspension means 1. The said electrical voltage in the suspension means 1, and/or its discharge by way of the electrically conducting element, can now be determined by the monitoring device 3. On the basis of the said determined parameter of the electrostatic effect, a state can now be determined for a component to be monitored of the elevator system 40.

It has been shown in tests, for example, that the running state of the car, such as for example, the speed of travel of the car 41, has a direct influence on a parameter based on the electrostatic effect. By determining such a parameter, conclusions can thereby be drawn concerning the speed of travel of the elevator car 41.

Furthermore it has also been shown that a voltage of the suspension means or suspension apparatus 1 has a direct influence on parameters based on the electrostatic effect. If a suspension means 1 is relaxed, for example, which can occur in a fastening or fitting of the elevator car 41 or the counterweight 42, a parameter of the electrostatic effect turns out to be smaller than is the case with normally loaded suspension means 1.

Furthermore a state of the jacket of the suspension means or suspension apparatus 1 has a direct influence on a parameter based on the electrostatic effect. If, for example, the said jacket is rough or dirty, this has a direct influence on the transfer of electrons from the drive pulley 43 onto the jacket of the suspension means 1. Here too a parameter determined can be used to deduce a state of the jacket of the suspension means 1.

Furthermore a state of tension load-carrying members, which are arranged in a jacketing of the suspension means or suspension apparatus 1, can also be determined. Since the tension load-carrying members of the suspension means 1 are used as electrical conductors for purposes of determining a parameter in conjunction with the electrostatic effect, an interruption of such an electrical conductor, or an earthing leakage in such an electrical conductor to an earthed component of the elevator system 40 can, for example, be detected. Thus, by the determination of a parameter in conjunction with the electrostatic effect a conclusion can be indirectly drawn concerning a state of the tension load-carrying members in the suspension means 1.

Figure 2:
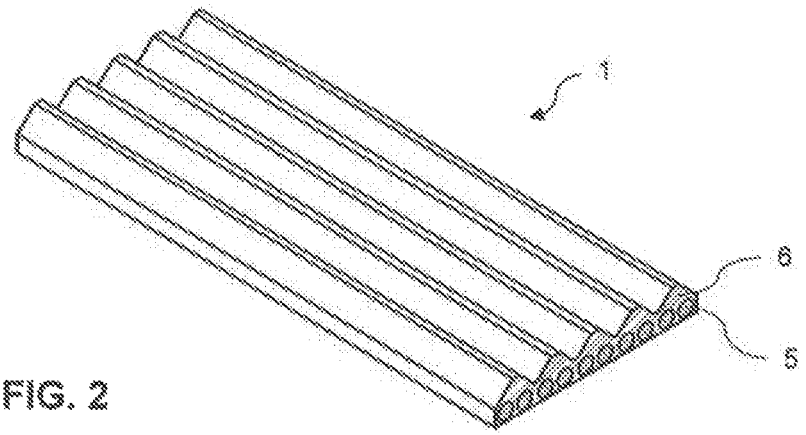
FIG. 2 shows an exemplary form of embodiment of a suspension means.

FIG. 2 represents a section of an exemplary form of embodiment of a suspension means or suspension apparatus 1. The suspension means 1 comprises a plurality of electrically conducting tension load-carrying members 5 arranged parallel to one another, which are encased in a jacket 6. For purposes of making electrical contact with the tension load-carrying members 5 the jacket 6 can, for example, be pierced or removed, or electrical contact can also be made with the tension load-carrying members 5 on their end faces with a contact device 2.

In this example the suspension means or suspension apparatus is fitted with longitudinal ribs on a traction face. Such longitudinal ribs improve the traction characteristics of the suspension means 1 on the drive pulley 43, and at the same time ease the lateral guidance of the suspension means 1 on the drive pulley 43. The suspension means 1 can, however, be configured in another manner, for example, without longitudinal ribs, or with another number, or another arrangement, of the tension load-carrying members 5. It is essential to the invention that the tension load-carrying members 5 are configured so as to be electrically conducting.

Figure 3A:
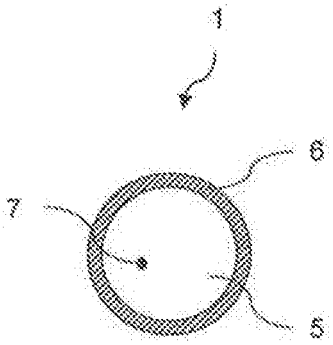
FIG. 3*a* shows an exemplary form of embodiment of a suspension means.

FIG. 3*a* represents a cross-section of a further exemplary form of embodiment of a suspension means or suspension apparatus 1. The suspension means 1 comprises an electrically non-conducting tension load-carrying member 5, which is encased in a jacket 6. In the electrically non-conducting tension load-carrying member 5 is arranged an indicator element 7, which is designed to be electrically conducting. For purposes of making electrical contact with the indicator element 7 the jacket 6 and the tension load-carrying members 5 can, for example, be pierced or removed, or the indicator element 7 can also make electrical contact on the end face of a contact device 2.

Figure 3B:
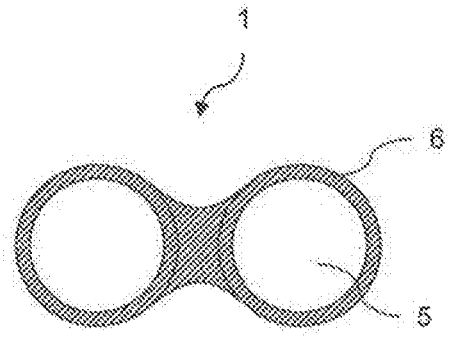
FIG. 3*b* shows an exemplary form of embodiment of a suspension means.

FIG. 3*b* represents a cross-section of a further exemplary form of embodiment of a suspension means or suspension apparatus 1. The suspension means 1 comprises two electrically conducting tension load-carrying members 5, which are encased in a jacket 6. Here one tension load-carrying member 5 is advantageously embodied in an S-twist, and the other tension load-carrying member 5 in a Z-twist. By this means it is achieved that the directions of lay are lifted such that under load the suspension means is not pulled out of the groove of the drive pulley. For purposes of making electrical contact with the tension load-carrying members 5 the jacket 6 can, for example, be pierced or removed, or electrical contact can also be made with the tension load-carrying members 5 on their end faces with a contact device 2.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A method for determining a state of at least one component of a suspension apparatus of an elevator system, wherein the suspension apparatus has at least one tension load-carrying member, which is surrounded by a non-metallic jacket, and wherein the suspension apparatus is guided by a drive pulley with a metallic traction surface, the method comprising the steps of:

determining at least one parameter based on an electrostatic effect that arises as a result of friction between the non-metallic jacket and the metallic traction surface of the drive pulley during a journey of the elevator system;

determining a state of the at least one component of the elevator system on the basis of the at least one parameter; and transmitting the state of the at least one component to an elevator controller for controlling the elevator system.

2. The method in accordance with claim 1 wherein the suspension apparatus includes at least one electrically conducting element.

3. The method in accordance with claim 2 wherein the at least one tension load-carrying member includes plastic fibers, and wherein the at least one electrically conducting element is an indicator element arranged in the suspension apparatus.

4. The method in accordance with claim 2 wherein the at least one electrically conducting element is the at least one tension load-carrying member formed of an electrically conducting material.

5. The method in accordance with claim 2 wherein the at least one parameter is at least one of an electrical voltage and an electrical current in the at least one electrically conducting element.

6. The method in accordance with claim 2 wherein the at least one electrically conducting element is the at least one tension load-carrying member formed of an electrically conducting material and the state is a state of the at least one tension load-carrying member.

7. The method in accordance with claim 6 wherein the state represents at least one of any contact of the at least one tension load-carrying member with an earthed element and a fracture of the at least one tension load-carrying member.

8. The method in accordance with claim 1 wherein the state is a loading state of the suspension apparatus.

9. The method in accordance with claim 8 including detecting a relaxation of stress in the suspension apparatus from the loading state of the suspension apparatus.

10. The method in accordance with claim 8 wherein the elevator system includes at least two of the suspension apparatus, and including detecting a distribution of a load onto the at least two suspension apparatuses from the loading state.

11. The method in accordance with claim 1 wherein the state is a running state of an elevator car suspended by the suspension apparatus.

12. The method in accordance with claim 11 wherein the running state is a speed of travel of the elevator car.

13. The method in accordance with claim 11 wherein the running state is at least one of a duration of a journey of the elevator car and a number of journeys of the elevator car.

14. The method in accordance with claim 1 wherein the state is a state of the jacket of the suspension apparatus.

15. The method in accordance with claim 14 wherein the state of the jacket represents at least one of any contamination of a surface of the jacket, a wear of the jacket surface, and an ageing of the jacket surface.

* * * * *